US006299531B1

(12) United States Patent
Bommarito

(10) Patent No.: US 6,299,531 B1
(45) Date of Patent: Oct. 9, 2001

(54) BACCARAT DISPLAY SYSTEM AND METHOD

(76) Inventor: Ted Bommarito, 258 Delfino Way, Henderson, NV (US) 89014

( * ) Notice: Subject to any disclaimer, the term of this patent is extended or adjusted under 35 U.S.C. 154(b) by 0 days.

(21) Appl. No.: 09/273,202

(22) Filed: Mar. 19, 1999

(51) Int. Cl.[7] ..... A63F 1/18

(52) U.S. Cl. ..... 463/12; 463/46; 273/309; 273/292; 273/274

(58) Field of Search ..... 463/12, 13, 17, 463/46, 36, 42; 273/309, 274, 292

(56) References Cited

U.S. PATENT DOCUMENTS

| | | | | |
|---|---|---|---|---|
| D. 190,503 | | 6/1961 | Barron . | |
| D. 276,630 | | 12/1984 | Gimbal . | |
| D. 376,825 | | 12/1996 | Hanscom . | |
| D. 383,171 | | 9/1997 | Hanscom . | |
| 4,223,893 | | 9/1980 | Shane et al. | 273/237 |
| 4,232,866 | | 11/1980 | Pennachio | 273/374 |
| 4,614,342 | | 9/1986 | Takashima | 463/46 |
| 4,659,087 | | 4/1987 | Shen et al. | 273/274 |
| 5,022,653 | | 6/1991 | Suttle et al. | 463/13 |
| 5,042,810 | * | 8/1991 | Williams | 273/142 |
| 5,159,549 | | 10/1992 | Hallman, Jr. et al. | 364/412 |
| 5,240,249 | | 8/1993 | Czarnecki et al. | 273/237 |
| 5,283,422 | * | 2/1994 | Storch et al. | 235/375 |
| 5,362,064 | | 11/1994 | Lofink et al. | 273/292 |
| 5,393,067 | | 2/1995 | Paulsen et al. | 273/292 |
| 5,395,119 | | 3/1995 | Jacob et al. | 273/274 |
| 5,397,133 | | 3/1995 | Penzias | 273/439 |
| 5,472,194 | * | 12/1995 | Breeding et al. | 463/42 |
| 5,490,670 | | 2/1996 | Hobert | 273/274 |
| 5,544,893 | | 8/1996 | Jones et al. | 273/309 |
| 5,570,885 | * | 11/1996 | Ornstein | 463/27 |
| 5,573,248 | | 11/1996 | Parra et al. | 273/274 |
| 5,586,766 | | 12/1996 | Forte et al. | 273/309 |
| 5,630,586 | | 5/1997 | Lowden | 273/138.2 |
| 5,669,817 | | 9/1997 | Tarantino | 463/13 |

* cited by examiner

*Primary Examiner*—Benjamin H. Layno
(74) *Attorney, Agent, or Firm*—Vanophem & Vanophem, P.C.

(57) ABSTRACT

The display system includes a plurality of displays prominently positioned about a baccarat table so that the bettors and onlookers of the baccarat table can easily view the displays and know past game results. The system includes a first counter for inputting a bank-win outcome, a second counter for inputting of a player-win outcome, and a third counter for inputting of a bank-player-tie outcome. The displays illustrate a matrix to allow input of indicia into each cell based on the results of each hand completed. The arrangement of the input of gaming results in the matrix gives a new player, and/or onlooker a complete history of past games played and resulting winners (bank, player or tie), as well as the consecutive games won and the frequency of wins by either the bank or player.

12 Claims, 3 Drawing Sheets

BACCARAT DISPLAY SYSTEM AND METHOD

BACKGROUND OF THE INVENTION

1. Field of the Invention

The invention involves a system and apparatus to improve the play of conventional baccarat and, more particularly, a display device that will enable all players to track game results without the need to keep individual tabulations.

2. Description of the Prior Art

In the past few decades, baccarat has grown to be a most prestigious game of chance table game. Part of the popularity of baccarat is the ambiance of the lavish private salons. Surrounded by glamorous shills, tuxedoed dealers, the bettors are extended liberties unheard of on the public casino floor. The bettors generally draw the cards from the shoe and crumple them in anger if they lose, eat at the tables complimentary of the casino food prepared by private chefs, smoke the finest cigars washed down with expensive drinks. Another attraction to baccarat is the large sums of money that are bet. Table minimums are typically higher than other table games, minimum, bets often start at $500 and maximum wagers of over $200,000 a hand are not uncommon. This eliminates the high rollers having to rub shoulders with the commoners.

Baccarat is an old card game originating in Italy. Baccarat originated in Italy, but it has long been regarded as a French import. "Baccarat" is French meaning "zero." This is important, as tens, Jacks, Queens, and Kings count as nothing, and the other cards count their respective face value. The object of baccarat is for the bettor to successfully wager on whether the bank's hand or the player's hand will have the highest value. The highest hand value in baccarat is nine. The bettor receives even money for this wager if he selects the winning hand and loses his wager if he selects the losing hand. Under the rules of play, the bank's hand has a slightly higher chance of winning than does the player's hand. Therefore, if the bettor wagers on the bank's hand the bettor must pay to the gaming establishment a commission (typically, 5%) of the amount the bettor wins. No commission is paid if the bettor successfully wagers on the player's hand. The cards are turned face up from which the value of the bank's hand, and the player's hand is readily determined.

Prior to the deal, each bettor can make one of three wagers: 1) the bank hand will win; 2) the player hand will win; or 3) the bank hand and the player hand will tie. Wagering locations are provided on the baccarat table layout. There are no options regarding drawing the third card for either the player's or bank's hand and baccarat is generally considered a game of chance (not skill). The bank announces the point count of the player's hand and the bank's hand and instructs the player when to draw additional cards if appropriate. All bets must be placed before the dealer calls "no more bets" and the cards are dealt. No more than one additional card will be drawn to each hand. The hand closest to 9 wins and shall be paid at odds of 1 to 1. If both the player and bank hand result in identical totals, it is a tie and neither hand wins or loses. Depending on the point total of the player's hand and the bank's hand, one more card may be dealt to either the player's hand, the bank's hand or both. The rules for determining whether a third card is dealt are fixed rules; there is no discretion for either the player's hand or the bank's hand on whether a third card is dealt. There are no choices to be made.

There are a number of patents that relate to baccarat and different variations thereof.

U.S. Pat. No. 5,395,119 to Jacob et al. sets forth modified wagering methods for baccarat. A variation to baccarat is disclosed wherein different types of "surrender rules" are provided wherein a player may surrender a portion of the bet depending on the value of the first two cards of the player and the bank hands. A separate surrender region is placed on the gaming table. This variant provides additional types of wagers that may be placed during the play of the game to increase the interest on the part of the players and to increase the profitability of the game for the casino.

U.S. Pat. No. 5,362,064 to Lofink et al. pertains to a modification of baccarat rules. This modification eliminates the conventional 5% commission charged by the gaming establishment. The system also provides a variation to baccarat wherein the player's and the bank's hands operate under the same criteria as to whether a third card is or is not dealt to each respective hand. In yet another variant, the patent uses a mechanical randomizing device to establish a "push" or "bar" situation for what otherwise would be a winning hand. Finally, the system permits side wagers to be added to the game. A player may make an additional wager on his hand with respect to a tic or for a natural situation.

U.S. Pat. No. 4,659,087 to Shen et al. discloses a casino game that combines elements of the games of blackjack (twenty one) and baccarat. The house or bank and the player(s) each receive four cards that are divided into two pairs according to the rules. The player(s) hands are then compared to the bank or house hands to determine win, loss or tie. The only wagering mentioned is that of betting upon a win, loss, or tie for either the player(s) or the house/bank. No bets on other aspects of the game are disclosed.

As stated above, baccarat is generally considered a game of chance and not skill where options must be considered by the players with respect to the cards dealt to each, as for example, in blackjack. For this reason, most players use a scorecard which is nothing more than a continuous listing of games played, and tracks whether the bank or player won the hand or if the hand was a draw. Many players use a system of darkening in a series of squares with different colors to designate the result of the continuous games. Such prior art card is shown in FIG. 1, wherein blue (depicted as B) designates that the bank won, red (depicted as R) that the player won and ties are shown by the diagonal line drawn in the square. Naturally new players coming to the table will want to, at best, see this scorecard and most will want to copy the results before sitting at the table to play. Also, each player will, during play, replay this scorecard on an ongoing basis. Clearly, casinos dislike this scorekeeping immensely for the reason that it takes away from the time a player could be playing the game and scorecard copying results in slowing down the game. Both reasons contribute to reducing casino revenue. Accordingly what is needed is a "scorecard" system that is handled by the bank that is accurate, convenient, quick, and results in speeding up the game of baccarat.

SUMMARY OF THE INVENTION

The baccarat scorecard display system of the present invention is a convenience to bettors, particularly high rollers, that enables them to not worry about manually tabulating game results, while enabling casinos to speed up the game because there is no downtime resulting from bettors, particularly high rollers, tracking prior gaming results.

The display system of the present invention improves customer retention to the baccarat game and also serves to provide potential players and onlookers of the baccarat table with information of the past results of previous games. The system of the present invention is bank, customer, and management friendly, and easy to operate. All of the players at the baccarat table and onlookers have an immediate, visual historical review of the ongoing baccarat games played on a specific table providing gaming results—bank wins, player wins and tics. The display system reduces downtime caused by bettors having to make entries of game results on their individual scorecards. The display mirrors actual historical gaming results. The system of the present invention also reduces tabulation mistakes that slow down the game as such mistakes are corrected.

The baccarat display system of the present invention includes a plurality of displays positioned about a baccarat table so that each bettor can easily view them and know historical gaming results. The displays are prominently displayed at the baccarat tables so that all bettors and onlookers can easily view them. The displays are either integral with the baccarat table or are a central system positioned onto the gaming table. The bettors have an improved sense of security knowing that the score is maintained centrally.

The display system includes an historical display of games played arranged in a sequential order to record and display the results to game participants and onlookers or new players entering the game. The display consists of an array of rectangular cells that are arranged with the Y axis or ordinate numbered from one to ten and the X axis or abscissa designated with the legend "GAME RESULTS". Each cell represents a game played. After the game is completed, the cell representing that game is marked, preferably by the bank, to reflect the results of that game. For example if the bank wins a predefined indicia is entered in the first cell, i.e., blue color, or other reference character. If the player wins a reference character representing a player is entered in the cell or alternatively the cell is colored red or if the game is a draw a diagonal line is drawn across the cell, as illustrated in FIG. 4.

If, after the second game is complete the results are the same as the first game, that is the player wins, the second cell in row one would be marked with the same indicia as in the first cell of row one so as to communicate to anyone seeing the display that the player has won 2 games in a row. If the results are opposite to the first game, that is the bank wins, the first cell in row two would be marked with the indicia representing a bank win. If the second game was a draw the second cell in row one would be marked with a diagonal line that represents a draw game.

If, after the third game is completed and the results are again the same as the second game, that is the player wins, the third cell in row one is marked with the same indicia as the first and second cells of row one to indicate that the player has won three games in a row. If the result of the third game is that the bank wins and the bank has won the previous game, the next cell in the row is marked with the indicia identifying the bank. If the player had won the previous game and then the bank won the third game, indicia identifying the bank would be placed in the first cell of the next row. If the previous game had been a draw, a comparison is made with the latest game played prior to the draw to determine where the indicia identifying the bank would be placed. If the game previous to the draw had been won by the bank, the results of the third game would be placed in the next cell in the same row as the previous draw and bank won results were found. If the player's hand won the game previous to the draw, the third game result would be placed in the first cell of the next row.

Accordingly, it is an object of the invention to provide an auto display with running tabulations of the outcome of previous games as well as to indicate the frequency of consecutive wins by the player, bank or designation of a draw or tie game.

It is a further object of this invention to provide a continuous display of ongoing baccarat games that improves customer retention to the baccarat game, eliminates the need of players having to keep individual scorecards and provides players as well as onlookers with an immediate, visual historical view of completed baccarat games arranged by whether the bank won, the player won or whether the result was a draw or tie.

It is yet a further object of the invention to provide a scoring system that is bank, customer and management friendly and that speeds up the game of baccarat.

It is still a further object of the invention to provide such a visual display that may be easily incremented, reset, or cleared by casino personnel at the baccarat table.

It is a yet further object of the invention that the visual display be an electronic LED-type display.

It is yet another object of the invention to provide a visual display that is simple and inexpensive to manufacture and that may be incorporated in existing baccarat tables.

These and other objects of the present invention will become apparent from the following detailed description of the preferred embodiment taken in conjunction with the attached drawings that are briefly described as follows.

DETAILED DESCRIPTION OF THE PREFERRED EMBODIMENT

A bettor is not to be confused with the player, as the player refers to the individual whose hand is in play, and the bank is the casino. As used herein "baccarat" applies to conventional baccarat, to midi-baccarat and to mini-baccarat. Mini-baccarat has between 5 and 8 bettors and resembles a blackjack table with one bank. Midi-baccarat has the same layout as mini-baccarat, except the bettors sit lower and handle the cards.

The casino can decide which of the three bank employees generally positioned at each table will be responsible for updating the display. In the preferred embodiment the stickman is responsible for updating the display, while in another preferred embodiment one of the two base dealers who pay off bets is responsible for updating the counter.

Figure 5:
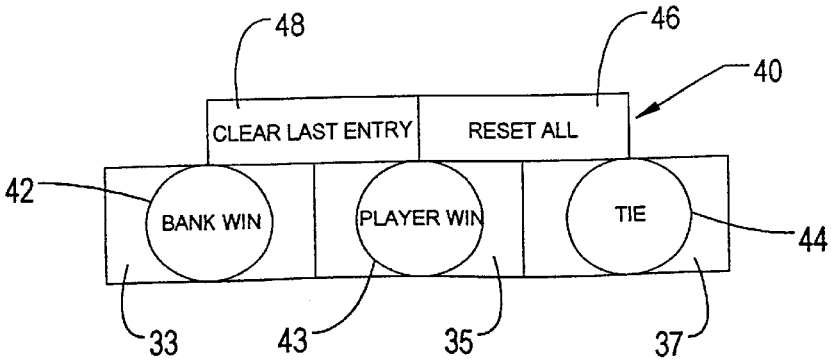
FIG. 5 is a view of the bank entry panel, enabling entry of the gaming result, a reset option, and a clear last entry option.
Figure 2:
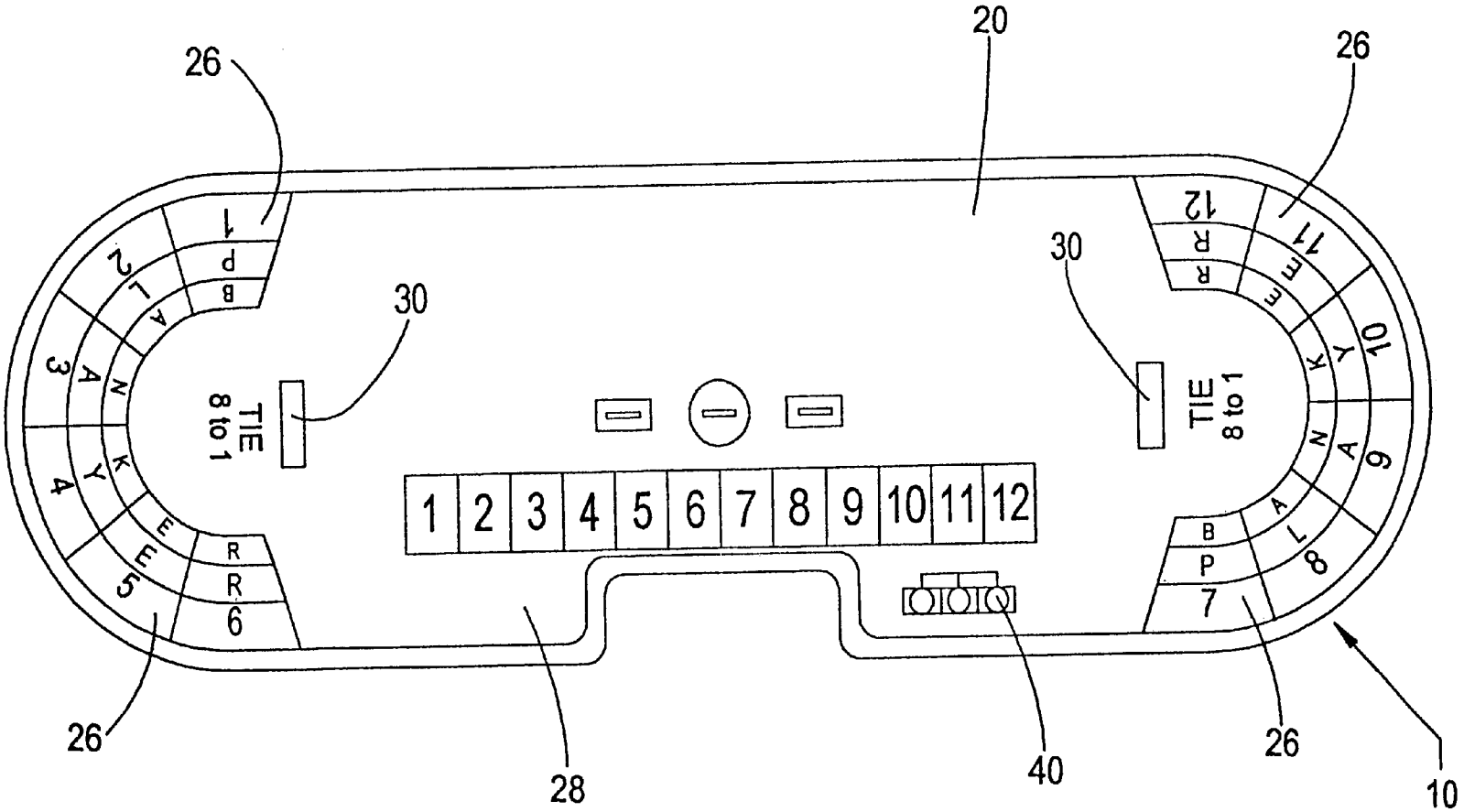
FIG. 2 is a top view of the preferred embodiment of the baccarat display system of the present invention illustrating a baccarat table with a display unit located at the opposing ends thereof.
Figure 3:
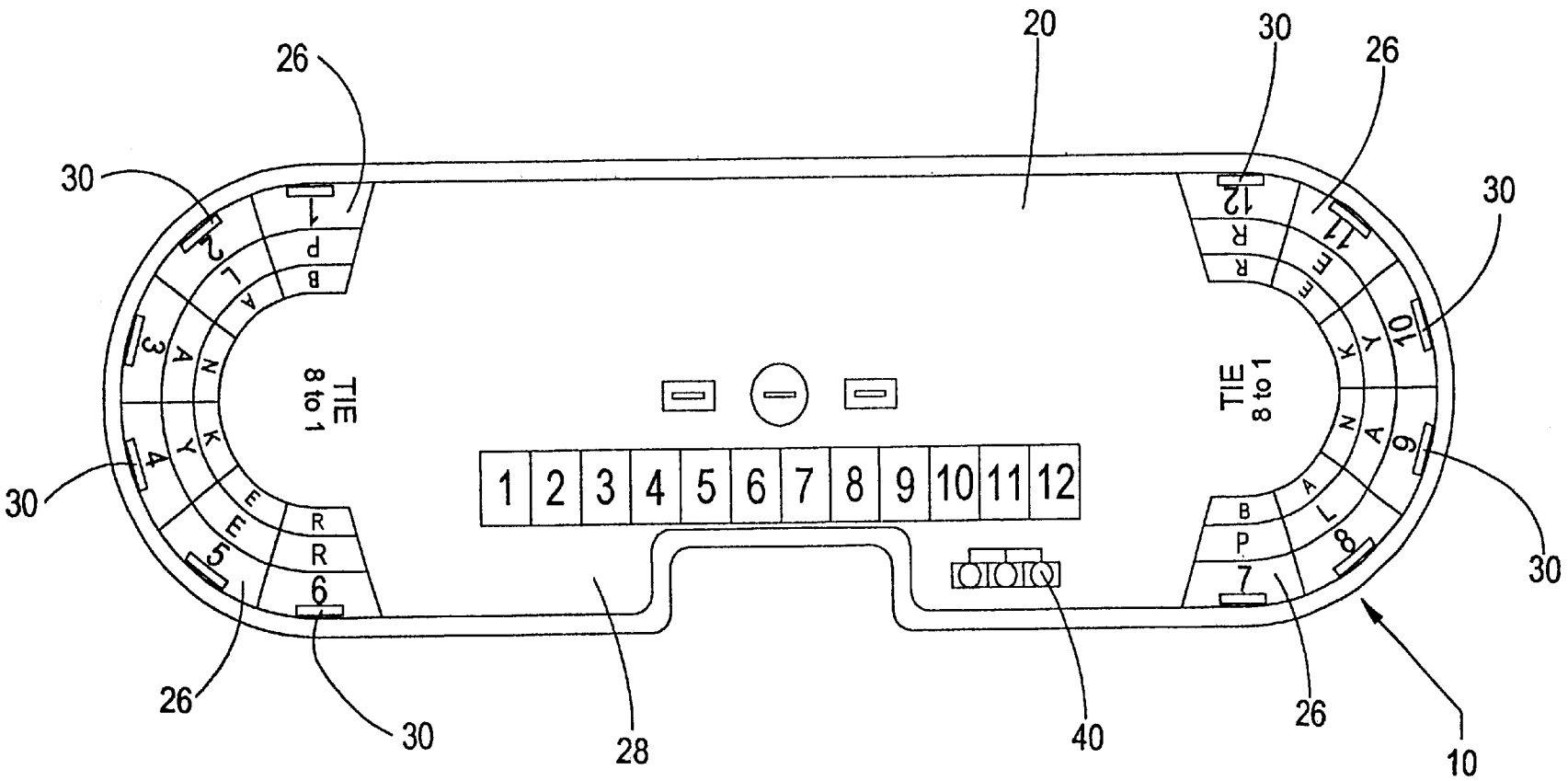
FIG. 3 is a top view of an alternate embodiment of the baccarat display system of the present invention with an individual display positioned at each player station.

The two preferred embodiments of the baccarat display system 10 of the present invention are shown in FIGS. 2, 3 and 5. FIG. 2 discloses a baccarat table 20 with a display apparatus disposed at opposing ends thereof and FIG. 3 discloses a baccarat table 20 with display units 30 positioned at individual bettor positions 26. The baccarat table layout is an oval with positions 28 for the casino dealer along one side of the oval and usually twelve bettor locations, six at each end of the oval. The bettor positions 26 are numbered one through twelve and each bettor position has an area designated for a wager on the bank hand and an area designated for a wager on the player hand. Locations are provided on the table layout where the cards of the bank hand and the cards of the player hand are displayed.

Figure 4:
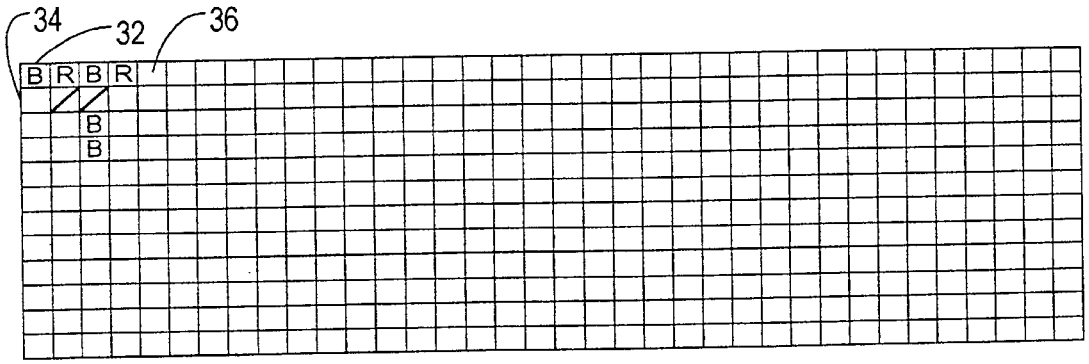
FIG. 4 is a pictorial view of one preferred embodiment of the display apparatus of the present invention.

FIG. 2 discloses a preferred embodiment of a display apparatus 30 of the present invention. The display apparatus 30 as viewed in FIG. 4 consists of a video screen depicting a matrix format with column 32 or row 34 array runs. Each column 32 represents a winning streak of either a player or the bank. Each cell represents a game played. The display is constructed using standard matrix element format Xij where i represents the row position and j represents the column position with the matrix. The cell element 36 within the matrix can be represented by three different symbols. For the purpose of the baccarat game disclosed, a blue shaded rectangle or cell (B) represents a game result where the bank has won; a red shaded rectangle or cell (R) represents a game result where the player has won; and a diagonal line drawn in the rectangle or cell from lower left to upper right represents a draw or tie game. In FIG. 4, a blue shaded rectangle is illustrated by a B, a red shaded rectangle by an R, and a draw game by a diagonal line. Building of the matrix display is accomplished by any one of the three casino personnel attending to the baccarat table. When the table opens the beginning of the program is initiated so that the i and j values are set equal to one. This will start the display at the first row and first column within the matrix display. The value or input of this element is determined by the outcome of the first hand completed. With reference to FIG. 4, if the bank wins the first hand a blue shaded rectangle B will be displayed within the first element of the matrix. If the player wins the first hand a red shaded rectangle R will be displayed within the first element of the matrix. If the first hand results in a draw or tie a diagonal line is displayed within the first element or cell of the matrix.

After the second hand is completed, the results or new input must be tested against the previously recorded element to determine if there is a difference (i.e., does the new input equal the previous element or is the new element a tie). If there is no difference (i.e., the new input value equals the previously recorded element) or the new element is a tie, the new indicator i is incremented by one and the matrix element value is set to the new input element value. The display indicates to the viewer that either the bank or the player has won two consecutive games. If after the above referenced test there is found to be a difference, that is the new input value does not equal the previous value and is not a tie, the row indicated i is reset to one and the column indicator j is incremented by one, and the matrix element value is recorded to be the new input value. The display will thereafter indicate that the second game was not a tie and whether, if the first game was won by the bank, the second game was won by the player or vice versa.

If the previous element tested, as set forth above, is a diagonal line, indicating a draw, the program must revert back to the last recorded value that is not represented by a diagonal line to make the comparison discussed above.

FIG. 4, as illustrated based on the above description of the display, communicates to a player or another the following sequence of 8 games played.

1) Game one was won by the bank;
2) Game two was won by the player;
3) The third hand was a draw;
4) The fourth hand was won by the bank;
5) The fifth hand was a draw;
6) The sixth hand was won by the bank;
7) The seventh hand was won by the bank; and
8) The eighth hand was won by the player.

As best shown in FIG. 5, the system also includes a panel 40 preferably disposed near the stickman. The panel 40 enables the stickman to increment each counter based upon the results of the previous gaming unit. The panel 40 also includes a reset option 46 and a clear option 48 if the last entry is in error.

As illustrated in FIG. 3, there are a plurality of display units 30 prominently positioned about the baccarat table 20 so that all bettors can easily view them. In the preferred embodiment (FIG. 2), there is a display at each bank position 28, each display being centrally controlled by the stickman. The displays units 30 are either integral with the baccarat table 20 or are a central system positioned onto the gaming table. The displays units 30 are preferably electronic displays such as LED-type units, but can also be mechanical counters such as wheels or roller flaps as are commonly known.

The panel 40 of the present invention 10 is utilized by one of the table personnel to increment the individual counters once each gaming unit is completed. The bank-win counter 33 is activated each time the bank wins, the player-win counter 35 is activated each time the player wins, and the tie or draw counter 37 is activated each time a tie occurs during play. The display(s) are updated after each game result is input so that players and onlookers can visually perceive the results well prior to the beginning of the next hand.

Figure 1:
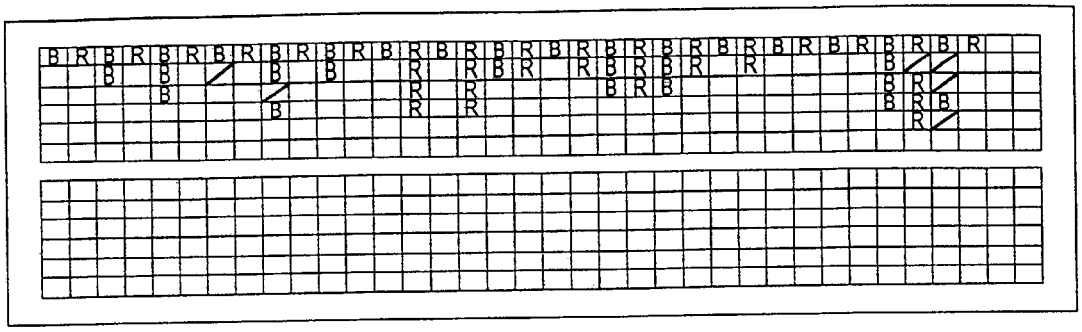
Fig.1 Prior Art
FIG. 1 is a typical prior art scorecard for a baccarat game.

The display unit 30 of the present invention enables casinos to increase the total amount of bets because there is no downtime as a result of bettors tracking gaming results manually as depicted in FIG. 1, particularly high rollers. Another primary advantage of the apparatus of the present invention is to improve customer retention to the baccarat game. The system of the present invention is bank and management friendly, and easy to operate. The system of the present invention may further include a processor control means, which may serve multiple gaming tables, a voice activated input signal and boolean logic. Yet another primary advantage of the apparatus of the present invention is that all players and potential players have an immediate visual review of the historical results of the baccarat game in progress—bank wins, player wins, and ties. Alternatively, if the casino so chooses, a printer could be hooked up to the gaming display for the convenience of new players. If the new player requests the history of prior game results illustrated on the display units 30 can be obtained at any time in print form. The player can choose how many past game results are desired and one of the attendants can enter the selection to allow the printer to print out past historical results. Of course, the individual bettors will always have the option to tally bank/player/tie status themselves on their own scorecard or to watch and use the table scorecard.

It is evident that many alternatives, modifications, and variations of the baccarat scoreboard apparatus of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What is claimed is:

1. An apparatus for displaying gaming results for a baccarat game, comprising:

a gaming table, sharing a designated player area and a designated dealer area;

at least one display means located on said gaming table for displaying a history of results of games played;

input means located at said designated dealer area of said gaming table;

a reset switch integral with said input means, said reset switch located at said designated dealer area of said gaming table; and processor control means having means for storing indicia representative of the outcome of games played as received from said input means at said gaming table, whereby said processor control means stores said input received from said input means and generates an updated display output on said at least one display means based on a logic test of said input provided by said input means such that gaming participants and bystanders can visually perceive a history of games played at said gaming table as well as the pattern of consecutive player/dealer wins and tie games sequencing.

2. The apparatus for displaying gaming results as claimed in claim 1, wherein said at least one display means comprises an array of light elements representing said updated display output.

3. The apparatus for displaying gaming results as claimed in claim 1, wherein said at least one display means comprises a video display representing said updated display output.

4. The apparatus for displaying gaming results as claimed in claim 1, wherein said at least one display means comprises a display means located at said designated player area of said gaming table.

5. The apparatus for displaying gaming results as claimed in claim 1, wherein said input means is located at said designated dealer area of said gaming table.

6. The apparatus for displaying gaming results as claimed in claim 1, wherein said input means comprises a voice activated input signal.

7. The apparatus for displaying gaming results as claimed in claim 1, wherein said processor control means serves multiple gaming tables.

8. The apparatus for displaying gaming results as claimed in claim 1, wherein said logic test comprises Boolean logic.

9. The apparatus for displaying gaming results as claimed in claim 1, further comprising means for resetting said at least one display means.

10. The apparatus for displaying gaming results as claimed in claim 9, wherein said means for resetting means comprises a manually activated reset switch integral with said input means, said reset switch located at said designated dealer area of said gaming table.

11. The apparatus for displaying gaming results as claimed in claim 9, wherein said means for resetting means comprises an automatic switch integral with said processor control means.

12. The apparatus for displaying gaming results as claimed in claim 1 wherein said at least one display means comprises a display means centrally located on said gaming table whereby all players and bystanders can readily visualize said display means.

* * * * *

UNITED STATES PATENT AND TRADEMARK OFFICE

CERTIFICATE OF CORRECTION

PATENT NO. : 6,299,531 B1
DATED : October 9, 2001
INVENTOR(S) : Bommarito

It is certified that error appears in the above-identified patent and that said Letters Patent is hereby corrected as shown below:

Title page,
Item [57], eleventh line, following "player" delete the comma "," .

Column 2,
Line 22, delete "tic"and insert -- tie --.

Column 3,
Line 8, delete "tics" and insert -- ties --.

Column 4,
Line 33, delete a period "." and insert a semi-colon -- ; --.

Column 6,
Line 20, delete "displays" and insert -- display --.
Line 22, delete "displays" and insert -- display --.
Line 52, after "requests" insert a comma -- , --.

Column 8,
Line 21, delete "means" second occurrence.
Line 26, delete "means" second occurrence.
Line 30, after "1" insert a comma -- , --.

Signed and Sealed this

Twelfth Day of March, 2002

*Attest:*

*Attesting Officer*

JAMES E. ROGAN
*Director of the United States Patent and Trademark Office*